United States Patent [19]

Higuchi

[11] Patent Number: 4,679,027

[45] Date of Patent: Jul. 7, 1987

[54] VIDEO DISPLAY CONTROL UNIT

[75] Inventor: Keizo Higuchi, Itami, Japan

[73] Assignee: Mitsubishi Denki Kabushiki Kaisha, Tokyo, Japan

[21] Appl. No.: 739,218

[22] Filed: May 30, 1985

[30] Foreign Application Priority Data

Jul. 24, 1984 [JP] Japan ..... 59-156017

[51] Int. Cl.[4] ..... G09G 1/00

[52] U.S. Cl. ..... 340/723; 340/814; 340/735

[58] Field of Search ..... 340/747, 744, 748, 750, 340/701, 703, 735, 790, 723, 814

[56] References Cited

U.S. PATENT DOCUMENTS

| | | | |
|---|---|---|---|
| 4,345,244 | 8/1982 | Greer et al. | 340/744 X |
| 4,401,985 | 8/1983 | McVoy et al. | 340/744 X |
| 4,485,378 | 11/1984 | Matsui et al. | 340/750 |
| 4,581,611 | 4/1986 | Yang et al. | 340/750 |
| 4,591,845 | 5/1986 | Komatsu et al. | 340/748 X |

OTHER PUBLICATIONS

"Dedicated Processor Shrinks Graphics Systems to 3 Chips", Bob Williamson and Peter Rickert, Electronics Design, Aug. 4, 1983, pp. 143–146 and 148.

"VLSI CRT Controller Cuts Parts Count of Displays", Richard Nesin, Electronic Design, Feb. 9, 1984, pp. 135–138, 140, 142 and 144.

*Primary Examiner*—Marshall M. Curtis

*Attorney, Agent, or Firm*—Lowe Price LeBlanc Becker & Shur

[57] ABSTRACT

A video display control unit controls characters to be displayed on a sequential scanning display unit (4). Namely, it reads address-specifying information and attribute information from a video memory (5) along scanning sequence of a screen in a continuous and address-unit time-divisional manner on the basis of address signals from a memory address counter (6). The read attribute information is outputted on a multiplex bus (42) through a gate (34) and delayed by a predetermined period by a pipeline register (40) to be supplied to a video signal encoder (18). The read address information is supplied to a character generator (16) so that character information is read from the character generator (16). The character information is outputted on the multiplex bus (42) through a gate (36) and delayed by a predetermined period in a pipeline register (38) to be supplied to the video signal encoder (18). The video signal encoder (18) outputs video signals on the basis of the attribute information and the character information.

3 Claims, 8 Drawing Figures

VIDEO DISPLAY CONTROL UNIT

BACKGROUND OF THE INVENTION

1. Field of the Invention

The present invention relates to a video display control unit. More specifically, it relates to a video display control unit which generates characters and/or graghic patterns on the basis of video information stored in a video memory thereby to display the characters and/or graphic patterns on a sequential scanning display unit.

2. Description of the Prior Art

Such a unit for storing data on picture images to be displayed in a video memory and reading the data from the video memory thereby to display the same on, e.g., a CRT display unit are well known by, for example, "Dedicated processor shrinks graphics system to 3 Chips" reported by Bob Williamson and Pete Rickert, Electronics Design, Aug. 4, 1983 and "VLSI CRT Controller cuts parts count of displays" reported by Richard Nesin, Electronics Design, Feb. 9, 1984.

FIG. 1 is a schematic block diagram showing a conventional video display control unit, and FIG. 2 is a definite block diagram of a video signal encoder as shown in FIG. 1. Referring to FIG. 1, description is now made on structure of the conventional video display control unit. The video display control unit includes a controller 1 for controlling the entire unit. Video information is displayed on a sequential scanning display unit 4, which displays picture images on a screen by continuously scanning video signals in the horizontal or vertical direction. Data on the video information to be displayed on the sequential scanning display unit 4 are stored in a video memory 5. The entire video display control unit is subjected to timing control by a clock and timing signal generator 26 which generates timing clock signals.

In order to continuously read the data stored in the video memory 5 in synchronization with scanning lines of the sequential scanning display unit 4, provided is a video memory address counter 6 which receives clock signals from the clock and timing signal generator 26 through a line 25. The video memory address counter 6 counts the clock signals, so as to generate its counter outputs on an address bus 7 as video memory address signals. The controller 1 outputs video memory address signals on an address bus 2 for reading and writing the data. An address multiplexer 8 receives selection signals from the clock and timing signal generator 26 through a line 24, thereby to switch the address buses 2 and 7 in response to the selection signals. A data bus interface 9 is connected to the controller 1 through an input/output data bus 3. The data bus interface 9 receives selection signals from the clock and timing signal generator 26 through the line 24, thereby to interface reading and writing of the data by the controller 1.

The video memory 5 is connected through a display data bus 10 to the data bus interface 9, an attribute code latch 11 and a character generator address latch 13. The display data bus 10 receives reading and writing data outputted from the controller 1 and reading data outputted from the video memory address counter 6.

The data outputted on the display data bus 10 include character generator address information indicating addresses of a character generator 16 in which character code patterns are recorded and attribute information indicating qualification codes for character symbols to be displayed. For example, when colors are added to the character symbols to be displayed, the attribute information includes codes indicating the colors. The attribute information outputted on the display data bus 10 is stored in the attribute code latch 11 on the basis of the timing of latch signals supplied from the clock and timing signal generator 26 through a line 22. The stored attribute information is supplied to a video signal encoder 18 through a bus 12.

On the other hand, the character generator address information outputted on the display data bus 10 is stored in the character generator address latch 13 at the timing of latch signals supplied from the clock and timing signal generator 26 through a line 23. The stored character generator address information is supplied through a bus 14 to the character generator 16, which further receives row addresses from the video memory address counter 6 through a bus 15 in its low-order addresses. The character generator 16 thus outputs the character information on a bus 17 in accordance with the character generator address information and the row addresses respectively received through the buses 14 and 15. The character information outputted on the bus 17 is supplied to the video signal encoder 18 in a parallel manner with the attribute information from the aforementioned attribute code latch 11.

The video signal encoder 18 composes video signals on the basis of the attribute information and the character information supplied in a parallel manner through the buses 12 and 17. In further detail, the attribute information and the character information are simultaneously latched by the video signal encoder 18 based on latch signals supplied from the clock and timing signal generator 26 through a line 20. The video signal encoder 18 composes the character information and the attribute information on the basis of video clock signals received from the clock and timing signal generator 26 through a line 21, thereby to convert the same into the video signals.

Referring now to FIG. 2, the video signal encoder 18 is further described in detail. The attribute information outputted on the bus 12 as shown in FIG. 1 is latched into an attribute latch 29 at the rise timing of the latch signals received through the line 20. The character information outputted on the bus 17 is supplied to a parallel/series converter 31 similarly at the rise timing of the latch signals. The parallel/series converter 31 converts the character information from parallel data to series data at the timing of the video clock signals outputted through the line 21. The series data are supplied to a multiplexer 33 through a line 32.

The outputs from the attribute latch 29 is divided into low-order bits 30*a* and high-order bits 30*b*. The divided low-order and high-order bits 30*a* and 30*b* can be defined to include, e.g., color information or color tone information. The multiplexer 33 selects the low-order bits 30*a* or the high-order bits 30*b* on the basis of the series data outputted on the line 32.

The video signals composed by the video signal encoder 18 are thus supplied to the sequential scanning display unit 4 through the line 19. The sequential scanning display unit 4 receives synchronization signals for controlling the timing of the scanning lines from a synchronizing signal generator 27 through a line 28. The synchronizing signal generator 27 generates the synchronizing signals on the basis of address counter clock signals received from the clock and timing signal generator 26 through the line 25. The sequential scanning display unit 4 receives the video signals and the synchronizing signals to display the picture images.

FIG. 3 is a timing chart showing the timing of principal signals in the conventional video display control unit as shown in FIG. 1, and is illustrative of states of the respective signals from data in addresses MA +2x and MA+2x+1 of video memory addresses to the video signals outputted on the line 19.

FIG. 4 illustrates relation between physical positions on the screen and addresses of the video memory specified by the video memory addresses for displaying horizontal x characters and characters of vertical y rows. In FIG. 4, two memory addresses are assigned to a character. For example, the address MA+2x is formed by addresses MA+2x and MA+2x+1. In other words, the character in the second stage MA +2x from above in the left-hand direction on the screen is stored in the addresses MA+2x and MA+2x+1 in the video memory 5. Even addresses are assigned to the character generator address information while odd addresses are assigned to the attribute information. Namely, contents of the even addresses indicate the sorts of the characters to be displayed, and contents of the odd addresses indicate the manners of qualification such as addition of colors to the characters to be displayed.

FIG. 5 shows an example of display of a character "A" in the position MA+2x on the screen by the character pattern of 8×8 dots for one character, with horizontal dots showing the list of the scanning lines. The character pattern "A" is stored in the character generator 16 by dot pattern information of 0 or 1, to be read on the basis of the timing of the scanning lines. The row addresses are indicative of the sequence of the scanning lines corresponding to the said one character, and 0 to 7 addresses are required for outputting the character as shown in FIG. 5 having the vertical height of 8 dots. Character information outputted from the character generator 16 in the case of the row address 0 is 00100000 in this example. The attribute information may be so defined as to indicate, e.g., red when the character pattern is 0 and green when the same is 1.

FIG. 6 is a timing chart showing the scanning timing in the case of FIG. 5. In FIG. 6, one row address corresponds to one scanning line, and video memory addresses for horizontally displayed characters (x characters) are changed in one scanning line interval to repeat such scanning eight times, thereby to complete display of x characters in the horizontal direction.

Description is now made on operations of the conventional display control unit with reference to FIGS. 1 to 6. In order to display the display example as shown in FIG. 5 on the sequential scanning display unit 4, the controller 1 writes the character address information in the character generator 16 storing the character to be displayed, e.g., "A" and the attribute information indicating the qualification codes therefor respectively in the addresses MA+2x and MA+2x+1 in the video memory 5 through the address bus 2 and the input/output data bus 3. This operation is performed by switching the address multiplexer 8 to the controller 1 side on the basis of selection signals outputted on the line 24 to specify prescribed addresses of the video memory 5 through the address bus 2, thereby to supply the video memory 5 with data from the input/output data bus 3 through the data bus interface 9 and the display data bus 10.

Although the video memory address signal outputted from the controller 1 and the video memory signal outputted from the video memory address counter 6 are described as equal for easy understanding of the prior art example, such equalization is not necessarily required.

The data thus written in the video memory 5 by the controller 1 are continuously read in synchronization with the screen scanning sequence at the timing as shown in FIG. 3 by the video memory address signal received from the video memory address counter 6 through the address bus 7. In FIG. 3, the character generator address signal in the address MA+2x is stored in the character generator address latch 13 at the rise timing of a latch signal on the line 23. On the basis of the output from the character generator address latch 13 supplied through the bus 14 and a row address from the video memory address counter 6 supplied through the bus 15, the character generator 16 outputs corresponding character information on the bus 17. On the other hand, the attribute information is read from the subsequent address MA+2x+1 of the video memory 5, to be latched into the attribute latch 11 at the rise timing of a latch signal outputted on the line 22. The latched attribute information is outputted on the bus 12.

The character information outputted on the bus 17 and the attribute information outputted on the bus 12 are written in a parallel manner in the video signal encoder 18 at the rise timing of a latch signal outputted on the line 20, to be converted into a video signal on the basis of the video clock signal supplied through the line 21. The video signal outputted on the line 19 as shown in FIG. 3 indicates the example for outputting the dots of the first row address for displaying the character "A" as shown in FIG. 5.

The conventional video display control unit is in the above described structure, and hence it is necessary to supply the character information and the attribute information in a parallel manner to the video signal encoder 18. Therefore, input signals to the video signal encoder 18 are increased, followed by increase in number of input pins of a package such as an integrated circuit for containing the video signal encoder 18, leading to increase of signal lines around the package.

SUMMARY OF THE INVENTION

An object of the present invention is to provide a video display control unit which can reduce signal lines for information inputted in a video signal processing unit which outputs video signals on the basis of data on picture images to be displayed on a display unit.

Briefly stated, the video display control unit according to the present invention stores data on picture images to be displayed on the screen of a display unit every plurality of predetermined unit memory addresses for one display section in a video memory to read the data stored in the video memory along screen scanning sequence per unit memory address in a time-divisional manner, and delays the read data of the respective unit memory address by a predetermined period per unit to attain equal timing, thereby to supply the data in equal timing to a video signal processing unit in a parallel manner for converting the same into video signals.

Therefore, according to the present invention, the data stored in the video memory for each unit memory address are time-divisionally read to compensate time difference between the data following the time divisional operation in equal timing by delay means, thereby to reduce the number of signal lines for information in comparison with the case of directly supplying the data read from the video memory to the video processing unit.

In a more preferred embodiment of the present invention, a video memory stores character address information for reading character information from a character generator and attribute information for qualifying characters per unit memory address to read, on the basis of the character address information read from the video memory, corresponding character information from the character generator thereby to output the character information and the attribute information in a time-divisional manner and supply the same to a video processing unit. Further, first and second gate means are employed for multiplexing the character information and the attribute information, while pipeline registers are utilized as the delay means for delaying the attribute information and the character information.

The above and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
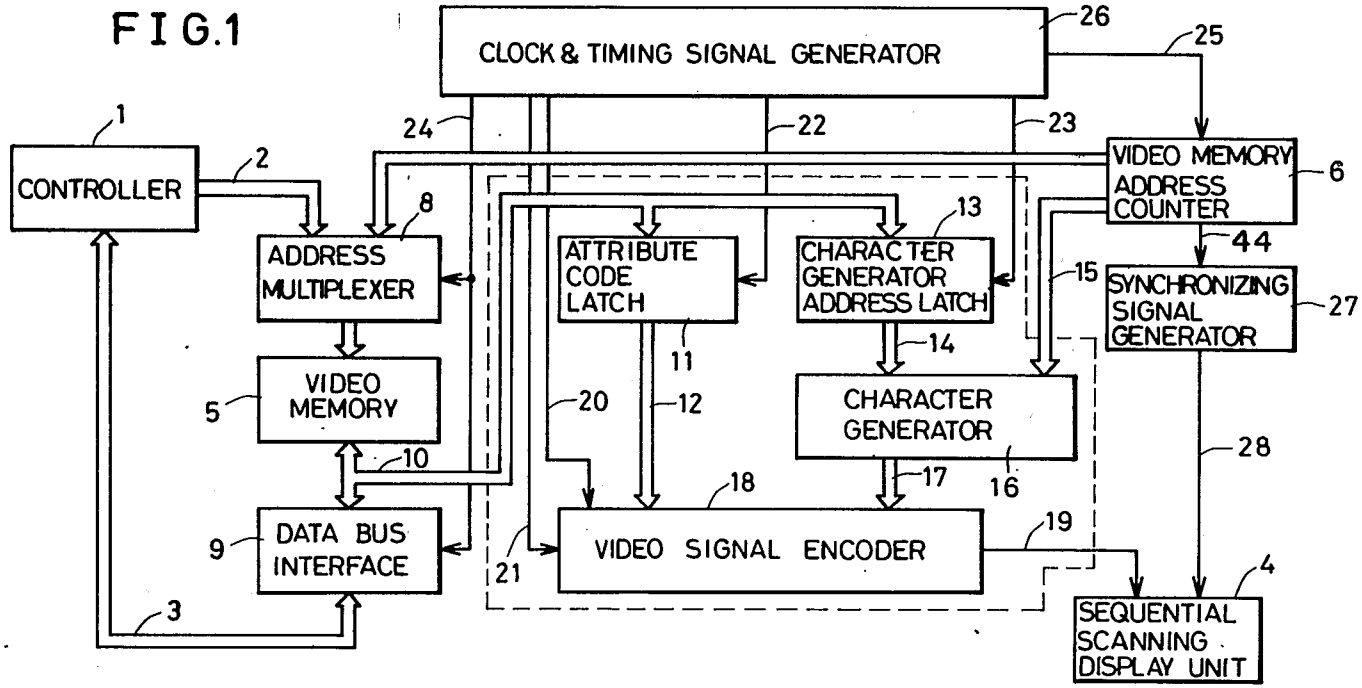
FIG. 1 is a schematic block diagram showing a conventional video display control unit.
Figure 2:
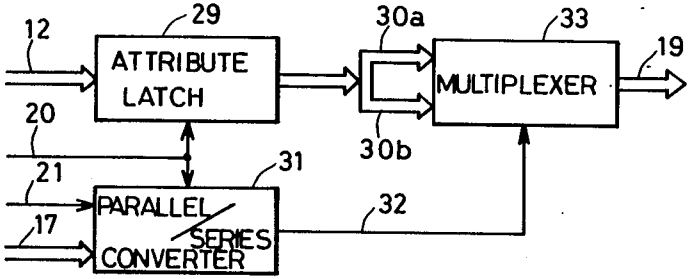
FIG. 2 PRIOR ART
FIG. 2. is a block diagram illustrating a video signal encoder as shown in FIG. 1 in further detail.
Figure 6:
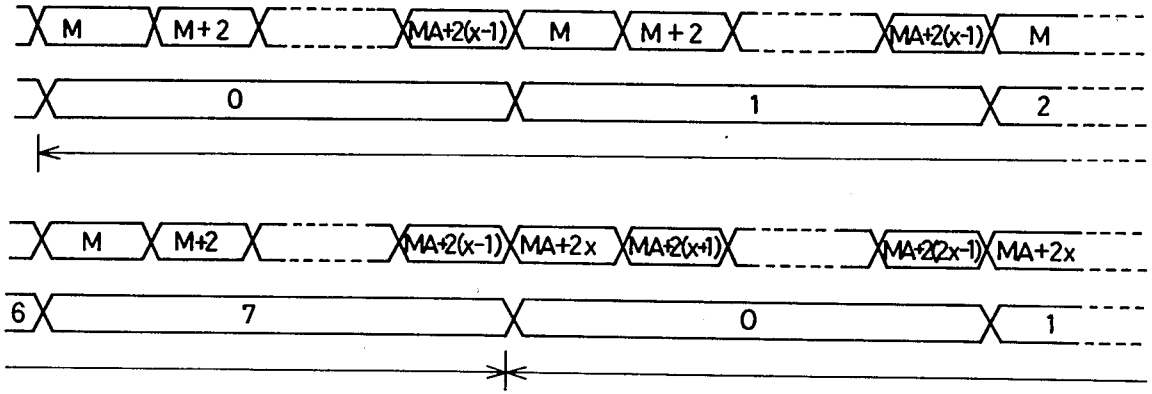
FIG. 6 PRIOR ART
FIG. 6 is illustrative of relation between general video memory addresses and row addresses of a video display control unit.
Figure 3:
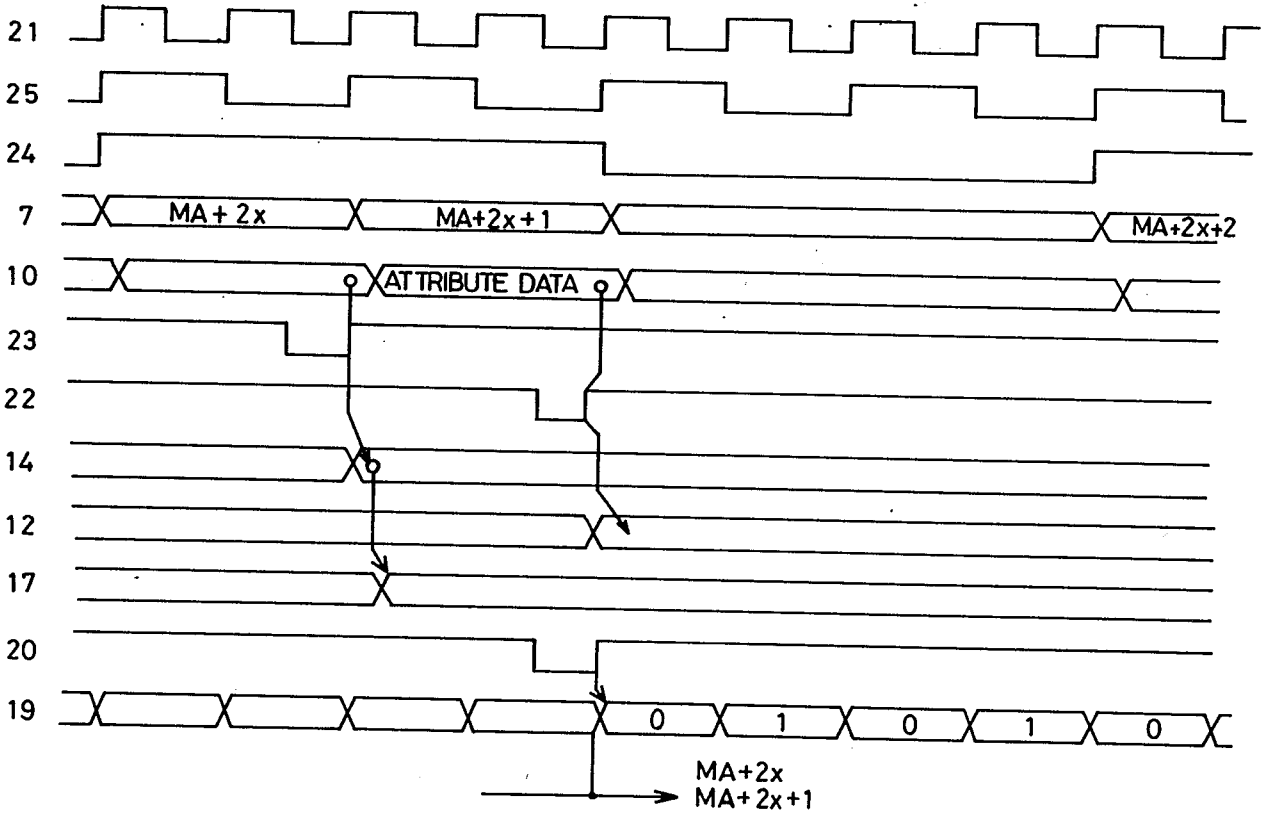
FIG. 3 PRIOR ART
FIG. 3 is a timing chart showing the timing of principal signals in the video display control unit as shown in FIG. 1.
Figure 4:
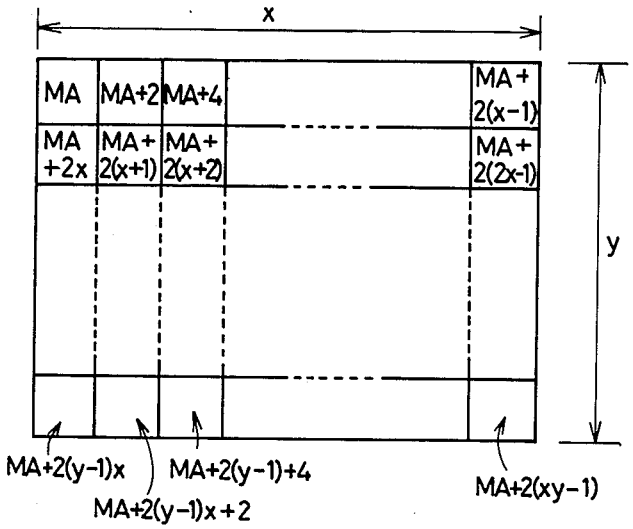
FIG. 4 PRIOR ART
FIG. 4 is illustrative of correspondence relation between general video memory address levels and the screen of a video display control unit.
Figure 5:
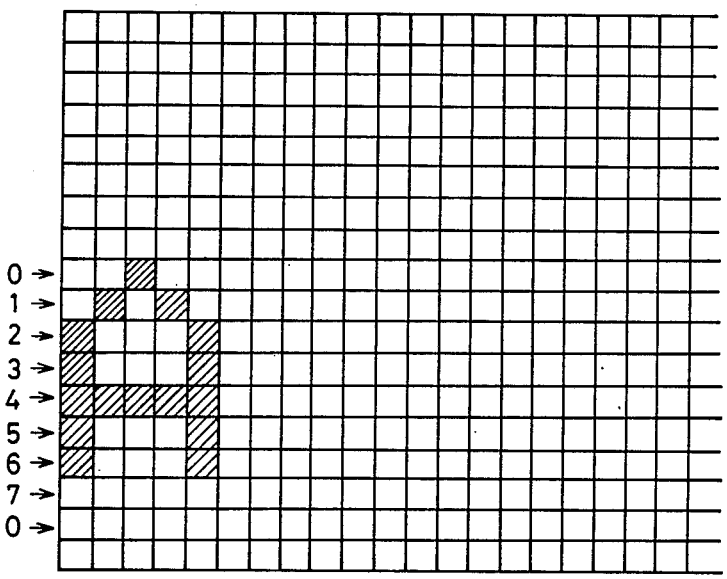
FIG. 5 PRIOR ART
FIG. 5 is an illustration showing an example of a character displayed on the screen.
Figure 7:
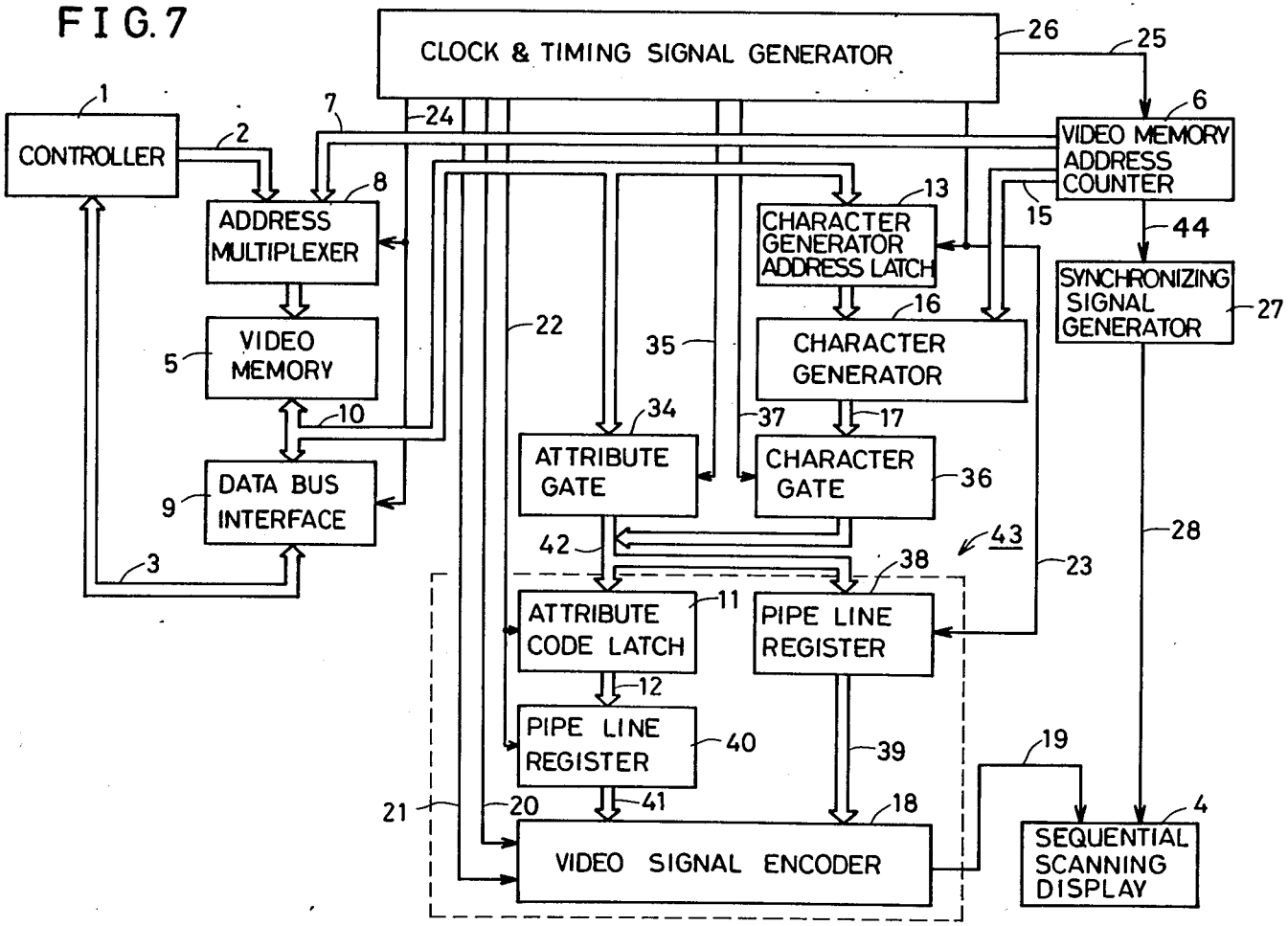
FIG. 7 is a schematic block diagram showing an embodiment of the present invention.

FIG. 7 is a schematic block diagram showing an embodiment of the present invention. The block diagram as shown in FIG. 7 is substantially identical in structure to that shown in FIG. 1 except for an improvement introduced into a portion enclosed by the dotted line in FIG. 1, and the following description is made only with respect to the improved portion.

The embodiment of the present invention is provided with two gates for multiplexing operations, which are implemented by an attribute gate 34 and a character gate 36. The attribute gate 34 is adapted to output attribute information on a multiplex display data bus 42 on the basis of an attribute information control signal received from a clock and timing signal generator 26 through a line 35. The character gate 36 outputs character information on the multiplex display data bus 42 on the basis of a character control signal received from the clock and timing signal generator 26 through a line 37. The attribute information and the character information thus outputted through the attribute gate 34 and the character gate 36 are outputted through the multiplex display data bus 42 to the area of a video signal processing unit 43.

The video signal processing unit 43 includes an attribute information latch 11, pipeline registers 38 and 40 and a video signal encoder 18. The attribute information latch 11 is adapted to latch the attribute information received through the multiplex display data bus 42 at the rise timing of a latch signal supplied from the clock and timing signal generator 26 through a line 22. The attribute information latched into the attribute information latch 11 is supplied to the pipeline register 40 through a bus 12. The pipeline register 40 receives through the bus 12 the attribute information latched into the attribute information latch 11 at the rise timing of a latch signal outputted from the clock and timing signal generator 26 through the line 22, thereby to store the same at the rise timing of a subsequent latch signal similarly outputted on the line 22. On the other hand, the pipeline register 38 stores character information read from a character generator 16 immediately before a new address signal is latched by a character generator address latch 13 at the rise timing of a latch signal outputted from the clock and timing signal generator 26 through a line 23.

Respective outputs from the pipeline registers 38 and 40 are supplied to the video signal encoder 18 through buses 39 and 41. The video signal encoder 18 simultaneously latches the character information outputted on the bus 39 and the attribute information outputted on the bus 41 at the rise timing of a latch signal outputted on a line 20. The character information and the attribute information thus latched are converted into a video signal on the basis of a video clock signal supplied through a line 21, similarly to the foregoing description made with reference to FIG. 1.

Figure 8:
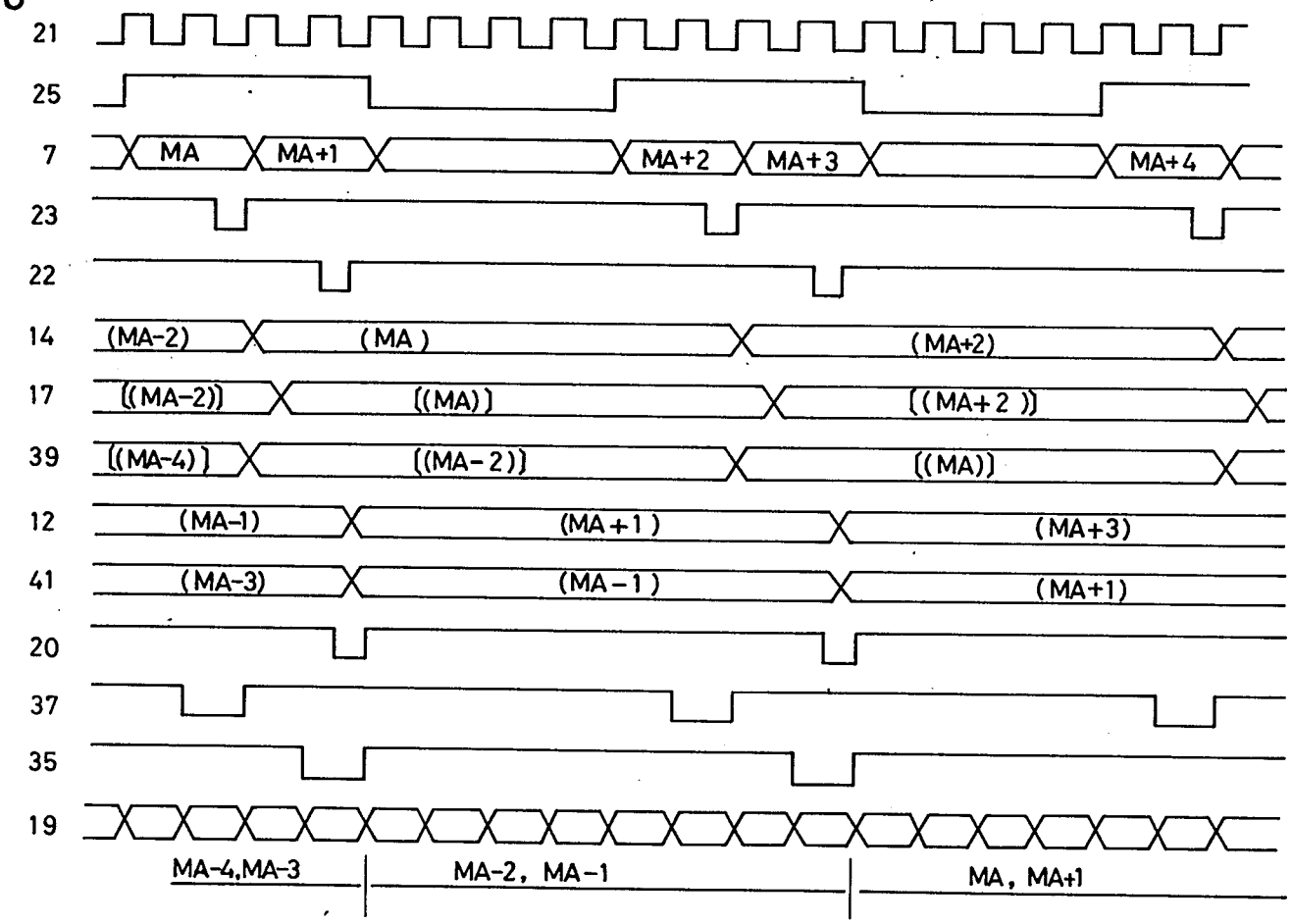
FIG. 8 is a timing chart of principal signals in the embodiment as shown in FIG. 7.

FIG. 8 is a timing chart showing the timing of principal signals in the embodiment as shown in FIG. 7. In FIG. 8, for example, symbol (MA) indicates the content of an address MA of a video memory 5, and symbol [(MA)] indicates the content of the character generator 16 specified by the content of the address MA in the video memory 5, i.e., the character dot pattern.

In order to output the attribute information and the character information on the multiplex display data bus 42 in the embodiment as shown in FIG. 7, the attribute gate 34 is opened at low level timing of an attribute control signal outputted on a line 35 and the character gate 36 is opened at low level timing of a character control signal outputted on a line 37. In other words, the attribute gate 34 and the character gate 36 are opened in a time-divisional manner whereby the attribute information and the character information are time-divided to be outputted on the multiplex display data bus 42. However, the attribute information and the character information are respectively time-divided, and hence delay is caused between the same whereby the attribute information and the character information cannot be simultaneously latched by the video signal encoder 18 at the timing of the latch signal outputted on the line 20. According to the present invention, therefore, the two pipeline registers 38 and 40 are provided in order to implement the same effect as the conventional display system while decreasing the bit number of the multiplex display data bus 42, which varies with the number of multiplexing stages, to less than a half.

Description is now made on operations of the embodiment as shown in FIG. 7, particularly on operations of the pipeline registers 38 and 40 from output of the address signals in the addresses MA and MA +1 on the video memory address bus 7 to output of the video signal based on the address signals on the line 19, with reference to FIGS. 7 and 8.

A video memory address counter 6 outputs address signals on an address bus 7 for specifying the addresses MA and MA+1. In response to the address signals, the video memory 5 outputs the content (MA) indicating the address information of the character generator 16 and the content (MA+1) indicating the attribute information on the display data bus 10. The character generator address information (MA) is latched into the character generator address latch 13 at the rise timing of the latch signal outputted on the line 23. Immediately before the latch signal is latched into the character generator address latch 13, the character generator address information (MA−2) indicative of the content of the address MA−2 is latched into the character generator address latch 13. Therefore, the character generator 16 outputs the character pattern [(MA−2)] which is the content of the specified address on the bus 17, on the basis of the character generator address information (MA−2) and the row address signal outputted on the bus 15. The character gate 36 outputs on the multiplex display data bus 42 the character information [(MA−2)] being outputted on the bus 17 at low level timing of the character control signal outputted on the line 37. The character information [(MA−2)] is stored in the pipeline register 38 at the rise timing of the latch signal being outputted on the line 23. Therefore, the pipeline register 38 stores the character information of the address MA−2 with respect to the address MA.

On the other hand, the attribute information (MA+1), which is the content of the address MA+1, is outputted on the multiplex display data bus 42 through the attribute gate 34 at low level timing of the attribute signal control signal. And at the rise timing of the latch signal outputted on the line 22, the attribute information (MA+1) is latched into the attribute information latch 11. The attribute information (MA+1) thus latched by the attribute information latch 11 is further stored in the pipeline register 40 at the rise timing of a subsequent latch signal outputted on the line 22. The attribute information (MA+1), which is the content of the address MA+1, is thus delayed by the pipeline register 40 by one attribute latch cycle, to be synchronized with the delay of the character information.

The video signal encoder 18 receives the character information and the attribute information thus synchronized respectively through the buses 39 and 41, thereby to simultaneously fetch the same at the rise timing of the latch signal outputted on the line 20. As shown in FIG. 8, therefore, the video signal outputted from the line 19 corresponds to the addresses MA−1 and MA−2 with respect to the video memory addresses for the addresses MA and MA+1, whereas a video signal corresponding to the addresses MA and MA+1 is outputted from the subsequent cycle.

Although the multiplex display bus 42 is time-divided into two stages, such time divisional operation can be performed in N stages (N=2, 3, . . . ), and in this case, the width of the multiplex display bus is effectively reduced to 1/N of that in case no multiplexing operation is performed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A video display control unit for displaying picture images on a sequential scanning display unit, said video display control unit comprising:

a character generator for generating character information;

a video memory including storage regions for storing both character address information to be supplied to said character generator to specify a character to be displayed and attribute information for qualifying said character to be displayed, said video memory for storing data defining said picture images to be periodically displayed on the screen of said display unit;

reading means for reading said data stored in said video memory synchronously with a scanning sequence of said screen including means for reading said character information and said attribute information from said video memory and for reading corresponding character information from said character generator on the basis of said read character address information;

multiplexing and outputting means to multiplex said character information and said read attribute information and output the same including first gate means for gating said attribute information, second gate means having an output end commonly connected to an output end of said first gate means for gating said character information, and timing signal generator means for sequentially switching said first and second gate means thereby to generate timing signals for multiplexing said attribute information and said character information;

delay means for delaying said data multiplexed by said multiplexing and outputting means by a predetermined period thereby to synchronously output data pairs of said character information and said attribute information in parallel; and a video encoder for receiving said data in parallel, said data having been delayed by said delay means thereby to convert said data into video signals to be supplied to said display unit.

2. A video display control unit in accordance with claim 1, wherein said reading means includes latch means for latching and temporarily storing said read character address information and thereafter outputting said temporarily stored address information to said character generator.

3. A video display control unit in accordance with claim 1, wherein said delay means include pipeline registers (38,40) for delaying said character information and said attribute information respectively by different periods thereby to supply the same to said video signal processing unit.

* * * * *